US010066497B2

(12) United States Patent
Duguay

(10) Patent No.: US 10,066,497 B2
(45) Date of Patent: Sep. 4, 2018

(54) ACTUATOR FOR GAS TURBINE ENGINE BLADE OUTER AIR SEAL

(71) Applicant: United Technologies Corporation, Hartford, CT (US)

(72) Inventor: Brian Duguay, Berwick, ME (US)

(73) Assignee: UNITED TECHNOLOGIES CORPORATION, Farmington, CT (US)

( * ) Notice: Subject to any disclaimer, the term of this patent is extended or adjusted under 35 U.S.C. 154(b) by 378 days.

(21) Appl. No.: 14/773,861

(22) PCT Filed: Feb. 18, 2014

(86) PCT No.: PCT/US2014/016768
§ 371 (c)(1),
(2) Date: Sep. 9, 2015

(87) PCT Pub. No.: WO2014/186015
PCT Pub. Date: Nov. 20, 2014

(65) Prior Publication Data

US 2016/0017743 A1 Jan. 21, 2016

Related U.S. Application Data

(60) Provisional application No. 61/775,844, filed on Mar. 11, 2013.

(51) Int. Cl.
*F01D 11/20* (2006.01)
*F01D 11/08* (2006.01)
*F01D 11/22* (2006.01)

(52) U.S. Cl.
CPC ..... *F01D 11/20* (2013.01); *F01D 11/08* (2013.01); *F01D 11/22* (2013.01);
(Continued)

(58) Field of Classification Search
CPC ..... F05D 2220/32; F05D 2240/12; F05D 2240/30; F05D 2240/55
See application file for complete search history.

(56) References Cited

U.S. PATENT DOCUMENTS 3,085,398 A 4/1963 Ingleson
4,127,357 A * 11/1978 Patterson ..... F01D 11/22 415/116

(Continued)

FOREIGN PATENT DOCUMENTS

EP 1243756 9/2002
EP 1243756 A1 * 9/2002 ..... F01D 11/22
EP 2273073 1/2011

OTHER PUBLICATIONS

Supplementary European Search Report for Application No. 14797409.1 dated Sep. 29, 2016.

(Continued)

*Primary Examiner* — Patrick Maines
(74) *Attorney, Agent, or Firm* — Carlson, Gaskey & Olds, P.C.

(57) ABSTRACT

A blade outer air seal (BOAS) actuator assembly, according to an exemplary aspect of the present disclosure includes, among other things, an actuator member; and a retractor configured to move with the actuator member to move a BOAS segment from a first position to a second position that is radially outside the first position, the BOAS segment seated against a support structure when in the first position and spaced from the support structure when in the second position.

17 Claims, 5 Drawing Sheets

(52) U.S. Cl.
CPC ..... *F05D 2220/32* (2013.01); *F05D 2240/11* (2013.01); *F05D 2240/12* (2013.01); *F05D 2240/30* (2013.01); *F05D 2240/55* (2013.01); *F05D 2260/57* (2013.01)

(56) References Cited

U.S. PATENT DOCUMENTS

| | | | | |
|---|---|---|---|---|
| 5,054,997 | A * | 10/1991 | Corsmeier | F01D 11/22 415/126 |
| 5,601,402 | A | 2/1997 | Wakeman et al. | |
| 5,639,210 | A | 6/1997 | Carpenter et al. | |
| 5,791,872 | A * | 8/1998 | Owen | F01D 11/24 415/173.2 |
| 2009/0266082 | A1* | 10/2009 | O'Leary | F01D 11/22 60/785 |
| 2009/0297330 | A1 | 12/2009 | Razzell et al. | |
| 2010/0003125 | A1* | 1/2010 | Smith | F01D 11/22 415/126 |
| 2010/0313404 | A1* | 12/2010 | Bates | F01D 11/22 29/402.01 |
| 2011/0044804 | A1 | 2/2011 | DiPaola et al. | |
| 2011/0293407 | A1 | 12/2011 | Wagner | |
| 2012/0275898 | A1 | 11/2012 | McCaffrey et al. | |
| 2013/0017057 | A1 | 1/2013 | Lagueux | |
| 2013/0209240 | A1* | 8/2013 | McCaffrey | F01D 11/22 415/173.2 |
| 2016/0053627 | A1* | 2/2016 | Duguay | F01D 11/20 277/305 |
| 2016/0053629 | A1* | 2/2016 | Duguay | F01D 11/22 415/1 |
| 2016/0312643 | A1* | 10/2016 | Davis | F01D 11/18 |

OTHER PUBLICATIONS

International Preliminary Report on Patentability for PCT Application No. PCT/US2014/016768, dated Sep. 24, 2015.
International Search Report and Written Opinion for PCT Application No. PCT/US2014/016768 dated Dec. 11, 2014.

* cited by examiner

ACTUATOR FOR GAS TURBINE ENGINE BLADE OUTER AIR SEAL

STATEMENT REGARDING FEDERALLY SPONSORED RESEARCH OR DEVELOPMENT

This invention was made with government support under Contract No. FA 8650-09-D-2923-0021 awarded by the United States Air Force. The Government has certain rights in this invention.

BACKGROUND

This disclosure relates to a blade outer air seal (BOAS) that may be incorporated into a gas turbine engine.

Gas turbine engines typically include a compressor section, a combustor section, and a turbine section. During operation, air is pressurized in the compressor section and is mixed with fuel and burned in the combustor section to generate hot combustion gases. The hot combustion gases are communicated through the turbine section, which extracts energy from the hot combustion gases to power the compressor section and other gas turbine engine loads.

The compressor and turbine sections of a gas turbine engine typically include alternating rows of rotating blades and stationary vanes. The turbine blades rotate and extract energy from the hot combustion gases that are communicated through the gas turbine engine. The turbine vanes prepare the airflow for the next set of blades. The vanes extend from platforms that may be contoured to manipulate flow.

An outer casing of an engine static structure may include one or more blade outer air seals (BOAS) that provide an outer radial flow path boundary for the hot combustion gases. Some BOAS are radially adjustable. Radial adjustments help accommodate component deflections due to engine maneuvers and rapid thermal growth. Cooling adjustable BOAS is often difficult.

SUMMARY

A blade outer air seal (BOAS) actuator assembly, according to an exemplary aspect of the present disclosure includes, among other things, an actuator member; and a retractor configured to move with the actuator member to move a BOAS segment from a first position to a second position that is radially outside the first position, the BOAS segment seated against a support structure when in the first position and spaced from the support structure when in the second position.

In a further non-limiting embodiment of the foregoing BOAS actuator, the retractor extends laterally from the actuator member.

In a further non-limiting embodiment of any of the foregoing BOAS actuators, the actuator member is a piston rod.

In a further non-limiting embodiment of any of the foregoing BOAS actuators, the retractor is separate from the BOAS segment.

In a further non-limiting embodiment of any of the foregoing BOAS actuators, at least one bumper extends radially from the retractor, the at least one bumper configured to contact a structure to limit radial movement of the BOAS segment.

In a further non-limiting embodiment of any of the foregoing BOAS actuators, the at least one bumper is configured to contact the structure when the BOAS segment is in the second position.

In a further non-limiting embodiment of any of the foregoing BOAS actuators, the structure comprises a control ring.

In a further non-limiting embodiment of any of the foregoing BOAS actuators, the retractor has a triangular profile.

In a further non-limiting embodiment of any of the foregoing BOAS actuators, the at least one bumper includes a bumper near each corner of the retractor.

A blade outer air seal (BOAS) actuator assembly, according to an exemplary aspect of the present disclosure includes, among other things, a seal body having a radial inner face that circumferentially extends between a first mate face and a second mate face and axially extends between a leading edge face and a trailing edge face; an attachment structure extending from a radially outer face of the seal body, the attachment structure including at least one hook; and a retractor configured to contact the at least one hook to move the BOAS segment from a first position to a second position that is radially outside the first position, the attachment structure of the BOAS segment seated against a support structure when in the first position and spaced from the support structure when in the second position.

In a further non-limiting embodiment of the foregoing BOAS assembly, the retractor is disconnected from the hook.

In a further non-limiting embodiment of any of the foregoing BOAS assemblies, the retractor is moveable relative to the hook.

In a further non-limiting embodiment of any of the foregoing BOAS assemblies, the BOAS segment is biased toward the first position.

In a further non-limiting embodiment of any of the foregoing BOAS assemblies, bleed air provides a biasing force.

A method of actuating a Blade Outer Air Seal (BOAS) according to another exemplary aspect of the present disclosure includes, among other things, moving a retractor against a portion of a BOAS segment to move the BOAS segment from a first position to a second position that is radially outside the first position, the BOAS segment seated against a support structure when in the first position and spaced from the support structure when in the second position.

In a foregoing non-limiting embodiment of the foregoing method, the retractor is separate from the BOAS segment.

In a foregoing non-limiting embodiment of any of the foregoing methods, the method includes limiting movement of the BOAS segment using bumpers that extend away from hooks of the BOAS segment.

In a foregoing non-limiting embodiment of any of the foregoing methods, the portion of the BOAS segment comprises at least one hook, and the retractor extends laterally from an actuator member to the at least one hook.

In a foregoing non-limiting embodiment of any of the foregoing methods, the portion is a first portion, and including resting a different second portion of the BOAS segment against flanges to limit radial inward movement of the BOAS segment.

Although the different examples have the specific components shown in the illustrations, embodiments of this disclosure are not limited to those particular combinations. It is possible to use some of the components or features from one of the examples in combination with features or components from another one of the examples.

DETAILED DESCRIPTION

Figure 1:
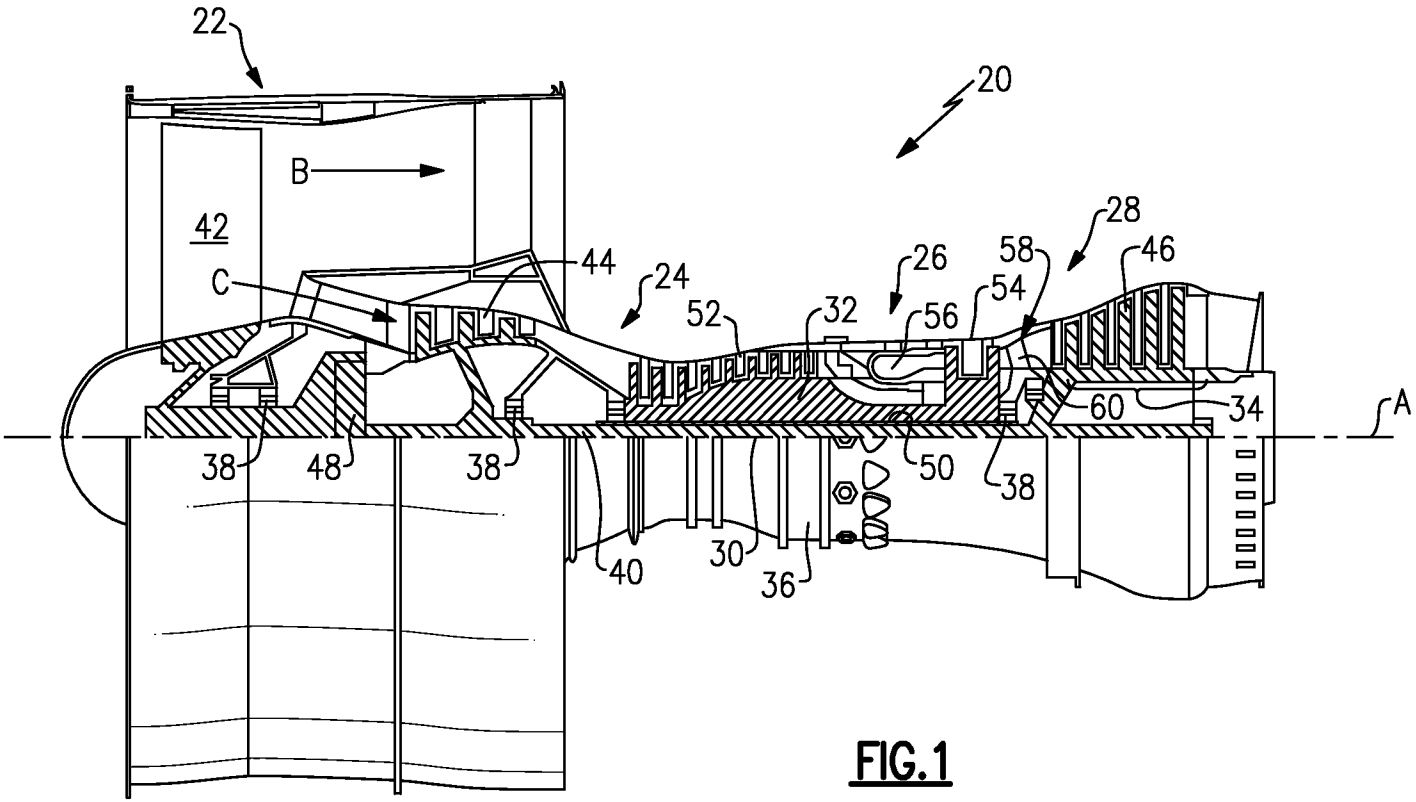
FIG. 1 illustrates a schematic, cross-sectional view of a gas turbine engine.

FIG. 1 schematically illustrates an example gas turbine engine 20 that includes a fan section 22, a compressor section 24, a combustor section 26, and a turbine section 28. Alternative engines might include an augmenter section (not shown) among other systems or features. The fan section 22 drives air along a bypass flow path B while the compressor section 24 draws air in along a core flow path C where air is compressed and communicated to a combustor section 26. In the combustor section 26, air is mixed with fuel and ignited to generate a high pressure exhaust gas stream that expands through the turbine section 28 where energy is extracted and utilized to drive the fan section 22 and the compressor section 24.

Although the disclosed non-limiting embodiment depicts a turbofan gas turbine engine, it should be understood that the concepts described herein are not limited to use with turbofans as the teachings may be applied to other types of turbine engines; for example a turbine engine including a three-spool architecture in which three spools concentrically rotate about a common axis and where a low spool enables a low pressure turbine to drive a fan via a gearbox, an intermediate spool that enables an intermediate pressure turbine to drive a first compressor of the compressor section, and a high spool that enables a high pressure turbine to drive a high pressure compressor of the compressor section.

The example engine 20 generally includes a low speed spool 30 and a high speed spool 32 mounted for rotation about an engine central longitudinal axis A relative to an engine static structure 36 via several bearing systems 38. It should be understood that various bearing systems 38 at various locations may alternatively or additionally be provided.

The low speed spool 30 generally includes an inner shaft 40 that connects a fan 42 and a low pressure (or first) compressor section 44 to a low pressure (or first) turbine section 46. The inner shaft 40 drives the fan 42 through a speed change device, such as a geared architecture 48, to drive the fan 42 at a lower speed than the low speed spool 30. The high speed spool 32 includes an outer shaft 50 that interconnects a high pressure (or second) compressor section 52 and a high pressure (or second) turbine section 54. The inner shaft 40 and the outer shaft 50 are concentric and rotate via the bearing systems 38 about the engine central longitudinal axis A.

A combustor 56 is arranged between the high pressure compressor 52 and the high pressure turbine 54. In one example, the high pressure turbine 54 includes at least two stages to provide a double stage high pressure turbine 54. In another example, the high pressure turbine 54 includes only a single stage. As used herein, a "high pressure" compressor or turbine experiences a higher pressure than a corresponding "low pressure" compressor or turbine.

The example low pressure turbine 46 has a pressure ratio that is greater than about five (5). The pressure ratio of the example low pressure turbine 46 is measured prior to an inlet of the low pressure turbine 46 as related to the pressure measured at the outlet of the low pressure turbine 46 prior to an exhaust nozzle.

A mid-turbine frame 58 of the engine static structure 36 is arranged generally between the high pressure turbine 54 and the low pressure turbine 46. The mid-turbine frame 58 further supports bearing systems 38 in the turbine section 28 as well as setting airflow entering the low pressure turbine 46.

The core airflow C is compressed by the low pressure compressor 44 then by the high pressure compressor 52 mixed with fuel and ignited in the combustor 56 to produce high speed exhaust gases that are then expanded through the high pressure turbine 54 and low pressure turbine 46. The mid-turbine frame 58 includes vanes 60, which are in the core airflow path and function as an inlet guide vane for the low pressure turbine 46. Utilizing the vane 60 of the mid-turbine frame 58 as the inlet guide vane for low pressure turbine 46 decreases the length of the low pressure turbine 46 without increasing the axial length of the mid-turbine frame 58. Reducing or eliminating the number of vanes in the low pressure turbine 46 shortens the axial length of the turbine section 28. Thus, the compactness of the gas turbine engine 20 is increased and a higher power density may be achieved.

The disclosed gas turbine engine 20 in one example is a high-bypass geared aircraft engine. In a further example, the gas turbine engine 20 includes a bypass ratio greater than about six (6), with an example embodiment being greater than about ten (10). The example geared architecture 48 is an epicyclical gear train, such as a planetary gear system, star gear system or other known gear system, with a gear reduction ratio of greater than about 2.3.

In one disclosed embodiment, the gas turbine engine 20 includes a bypass ratio greater than about ten (10:1) and the fan diameter is significantly larger than an outer diameter of the low pressure compressor 44. It should be understood, however, that the above parameters are only exemplary of one embodiment of a gas turbine engine including a geared architecture and that the present disclosure is applicable to other gas turbine engines.

A significant amount of thrust is provided by the bypass flow B due to the high bypass ratio. The fan section 22 of the engine 20 is designed for a particular flight condition—typically cruise at about 0.8 Mach and about 35,000 feet. The flight condition of 0.8 Mach and 35,000 ft., with the engine at its best fuel consumption—also known as "bucket cruise Thrust Specific Fuel Consumption ('TSFC')"—is the industry standard parameter of pound-mass (lbm) of fuel per hour being burned divided by pound-force (lbf) of thrust the engine produces at that minimum point.

"Low fan pressure ratio" is the pressure ratio across the fan blade alone, without a Fan Exit Guide Vane ("FEGV") system. The low fan pressure ratio as disclosed herein according to one non-limiting embodiment is less than about 1.50. In another non-limiting embodiment the low fan pressure ratio is less than about 1.45.

"Low corrected fan tip speed" is the actual fan tip speed in ft/sec divided by an industry standard temperature correction of [(Tram ° R)/(518.7° R)]^0.5. The "Low corrected fan tip speed," as disclosed herein according to one non-limiting embodiment, is less than about 1150 ft/second.

The example gas turbine engine includes the fan 42 that comprises in one non-limiting embodiment less than about twenty-six (26) fan blades. In another non-limiting embodiment, the fan section 22 includes less than about twenty (20) fan blades. Moreover, in one disclosed embodiment the low pressure turbine 46 includes no more than about six (6) turbine rotors schematically indicated at 34. In another non-limiting example embodiment the low pressure turbine 46 includes about three (3) turbine rotors. A ratio between the number of fan blades and the number of low pressure turbine rotors is between about 3.3 and about 8.6. The example low pressure turbine 46 provides the driving power to rotate the fan section 22 and therefore the relationship between the number of turbine rotors 34 in the low pressure turbine 46 and the number of blades in the fan section 22 disclose an example gas turbine engine 20 with increased power transfer efficiency.

Figure 2:
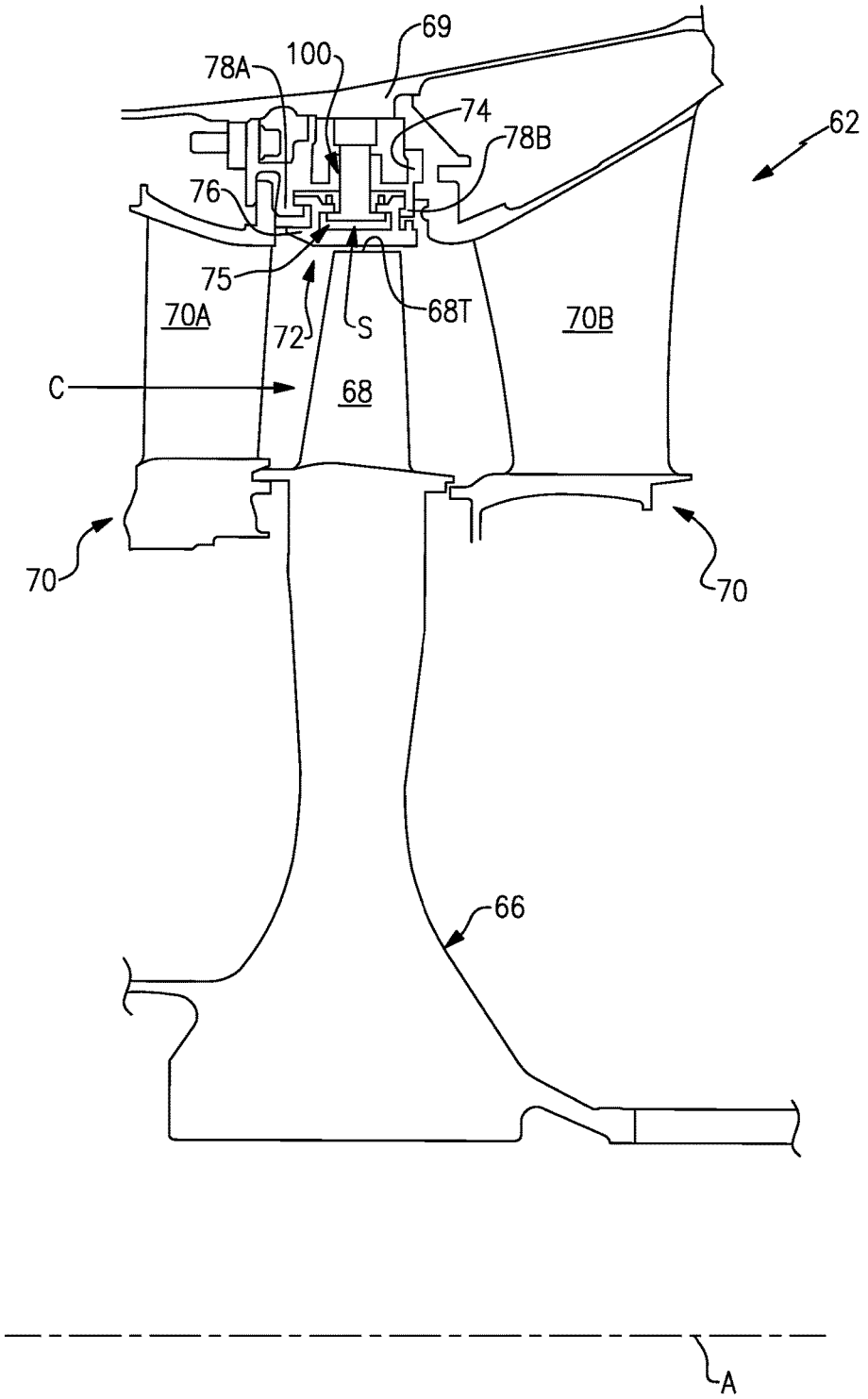
FIG. 2 illustrates a cross-section of a portion of a gas turbine engine.

FIG. 2 illustrates a portion 62 of a gas turbine engine, such as the gas turbine engine 20 of FIG. 1. In this exemplary embodiment, the portion 62 represents the high pressure turbine 54. However, it should be understood that other portions of the gas turbine engine 20 could benefit from the teachings of this disclosure, including but not limited to, the compressor section 24 and the low pressure turbine 46.

In this exemplary embodiment, a rotor disk 66 (only one shown, although multiple disks could be axially disposed within the portion 62) is mounted to the outer shaft 50 and rotates as a unit with respect to the engine static structure 36. The portion 62 includes alternating rows of rotating blades 68 (mounted to the rotor disk 66) and vanes 70A and 70B of vane assemblies 70 that are also supported within an outer casing 69 of the engine static structure 36. The outer casing may include a control ring.

Each blade 68 of the rotor disk 66 includes a blade tip 68T that is positioned at a radially outermost portion of the blades 68. The blade tip 68T extends toward a blade outer air seal (BOAS) assembly 72. The BOAS assembly 72 may find beneficial use in many industries including aerospace, industrial, electricity generation, naval propulsion, pumps for gas and oil transmission, aircraft propulsion, vehicle engines and stationery power plants.

The BOAS assembly 72 is disposed in an annulus radially between the outer casing 69 and the blade tip 68T. The BOAS assembly 72 generally includes a support structure 74 and a multitude of BOAS segments 76 (only one shown in FIG. 2). The BOAS segments 76 may form a full ring hoop assembly that encircles associated blades 68 of a stage of the portion 62. The support structure 74 is mounted radially inward from the outer casing 69 and includes forward and aft flanges 78A, 78B that mountably receive the BOAS segments 76. The forward flange 78A and the aft flange 78B may be manufactured of a metallic alloy material and may be circumferentially segmented for the receipt of the BOAS segments 76.

The support structure 74 may establish a cavity 75 that extends axially between the forward flange 78A and the aft flange 78B and radially between the outer casing 69 and the BOAS segment 76. A secondary cooling airflow S may be communicated into the cavity 75 to provide a dedicated source of cooling airflow for cooling the BOAS segments 76. The secondary cooling airflow S can be sourced from the high pressure compressor 52 or any other upstream portion of the gas turbine engine 20. During typical operation, the secondary cooling airflow S provides a biasing force that biases the BOAS segment 76 radially inward toward the axis A. In this example, the forward and aft flanges 78A, 78B are portions of the support structure 74 that limit radially inward movement of the BOAS segment 76 due to the biasing force.

Figure 3:
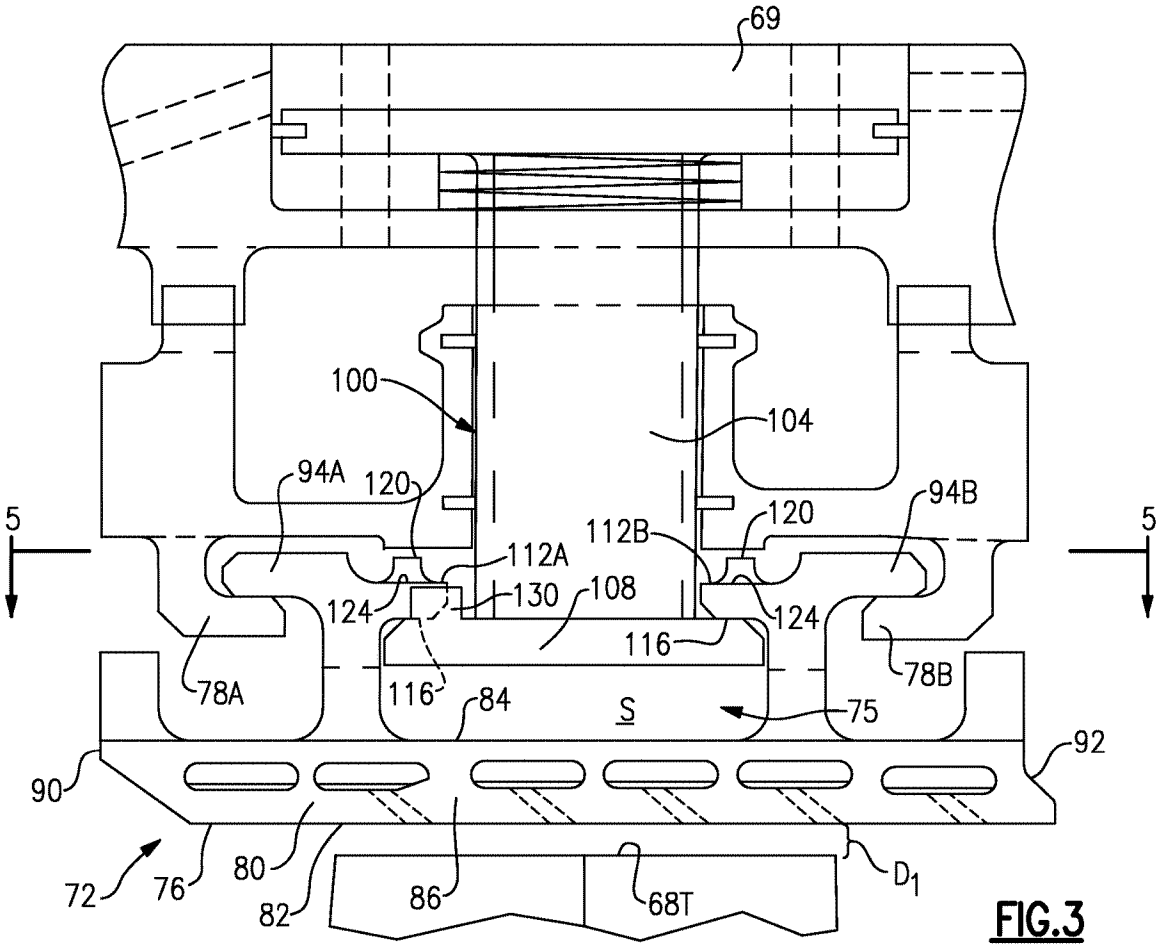
FIG. 3 illustrates a close up view of a blade outer air seal (BOAS) in of FIG. 2 in a first, extended position.
Figure 4:
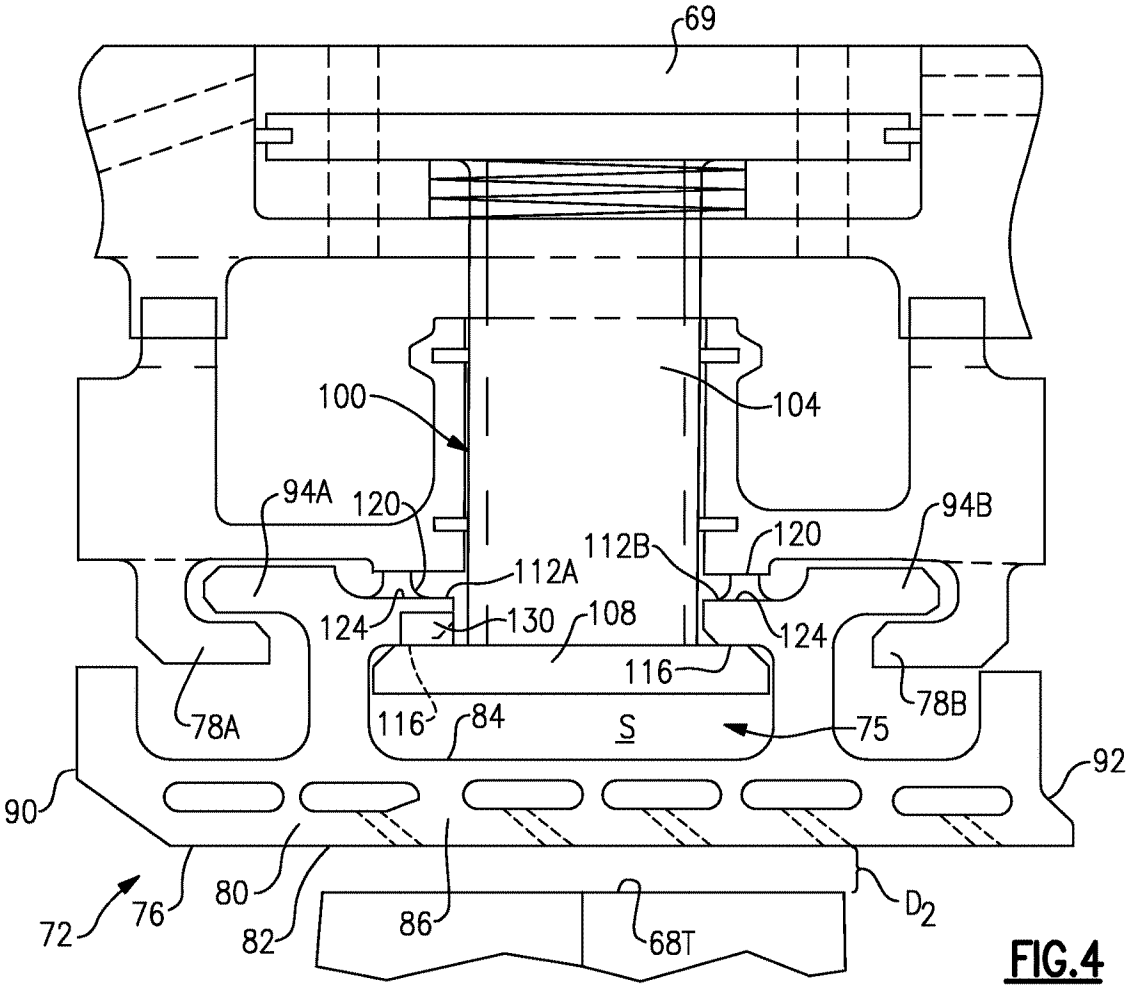
FIG. 4 illustrates a close up view of a blade outer air seal (BOAS) in of FIG. 2 in a second, retracted position.
Figure 5:
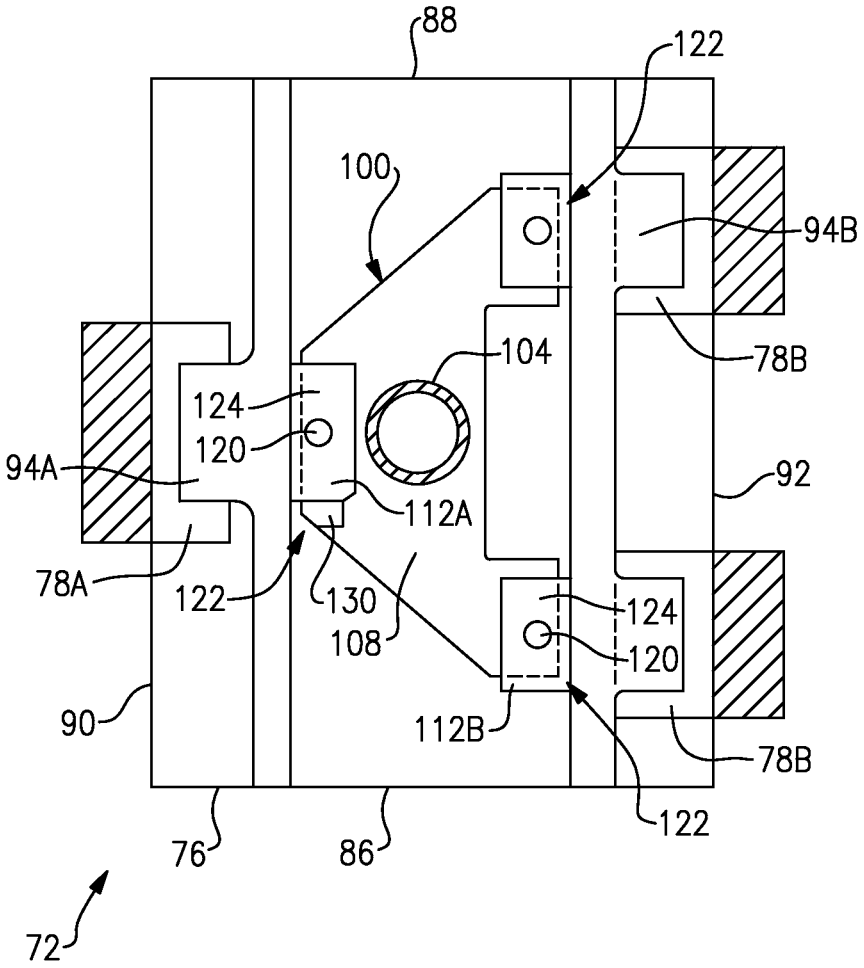
FIG. 5 illustrates a section view at line 5-5 in FIG. 3.

FIGS. 3 to 5 show one exemplary embodiment of the BOAS segment 76 that may be incorporated into the gas turbine engine 20. The example BOAS segment 76 includes a seal body 80 having a radially inner face 82 that faces toward the blade tip 68T and a radially outer face 84 that faces toward the cavity 75. The radially inner face 82 and the radially outer face 84 circumferentially extend between a first mate face 86 and a second mate face 88 and axially extend between a leading edge face 90 and a trailing edge face 92.

The example BOAS segment 76 is moved from a first position (FIG. 3) to a second position (FIG. 4) by a BOAS actuator assembly 100. The BOAS segment 76 is a distance $D_1$ from the blade tip 68T in the first position. The BOAS segment 76 is a distance $D_2$ from the blade tip 68T in the first position. The distance $D_2$ is greater than the distance $D_1$. The second position is radially outside the first position. The actuator assembly 100 is used to rapidly increase clearance to the blade tip 68T.

Again, during operation, the BOAS segment 76 is typically biased toward the first position due to the pressure differential between opposing radial sides of the BOAS segment 76. Laterally outward extending hooks 94A, 94B of the BOAS segment 76 each rest against a corresponding one of the flanges 78A, 78B when in the first position. The hooks 94A, 94B may extend in other directions in other examples. To move the BOAS segment 76 to the second position, the actuator assembly 100 moves the BOAS segment 76 against the biasing force to move the hooks 94A, 94B away from the flanges 78A, 78B. Bleed air typically pressurizes the cavity 75 resulting in the pressure differential.

The example actuator assembly 100 includes an actuator member 104 and a retractor 108. The actuator member 104 may be piston rod of a hydraulic piston, for example. The retractor 108, which is a retraction plate in this example, extends laterally from the actuator member 104 and is received underneath laterally inward extending hooks 112A, 112B of the BOAS segment 76. The hooks 112A, 112B are an example attachment structure of the BOAS segment 76. The retractor 108 is configured to contact radially inward facing surfaces 116 of the hooks 112A, 112B when the BOAS segment 76 is in the second position and, optionally, when the BOAS segment 76 is in the first position.

The example retractor 108 is disconnected and separate from the hooks 112A, 112B. The example retractor 108 is thus moveable relative to the hooks 112A, 112B.

In this example, the actuator member 104 retracts to move the BOAS segment 76 to the second position and, more specifically, to move the hooks 94A and 94B radially away from the flanges 78A, 78B. Retracting the actuator member 104 causes the retractor 108 to pull against the radially inward facing surfaces 116 of the hooks 112A, 112B, which overcomes the biasing force and pulls the BOAS segment 76 from the first position to the second position. In the first position, the BOAS segment 76 contacts the support structure 74 and specifically the hooks 78A, 78B. In the second position, the BOAS segment 76 is spaced from the support structure 74.

The retractor 108 is thus moved against a first portion of the BOAS segment 76 (the hooks 112A, 112B) to move a second portion of the BOAS segment 76 (the hooks 94A and 94B) away from the flanges 78A and 78B.

In this example, at least one radially extending bumper 120 extends from a radially outer surface 124 of the hooks 112A, 112B. The bumpers 120 can contact the outer casing 69, a portion of the support structure 74, or both to limit radial movement of the BOAS segment 76. The area of the radially outward facing surfaces of the at least one bumper 120 is less than the area of the radially outward facing surfaces 124. The bumper 120 thus facilitates a more focused transmission of load from the BOAS segment 76 into the outer casing, the support structure 74, etc. The bumper 120 also facilitates a consistent positioning of the BOAS segment 76.

The example retractor 108 has a generally triangular profile and with one of the bumpers 120 at or near each corner 122. One of the bumpers 120 is upstream from the actuator member 104 and the other two bumpers 120 are downstream from the actuator member 104 relative to a direction of flow through the engine 20.

In some examples, the bumpers 120 are omitted and the hooks 112A, 112B may be made radially thicker to limit radial movement of the BOAS segment 76. In such an example, the thicker hooks contact the outer casing 69, the support structure 74, etc. to limit radially outward movement of the BOAS segment 76 when retracted by the actuator assembly 100.

The bumpers 120, compared to thicker hooks 112A, 112B, utilize less material, which provides weight and material savings. The bumpers 120 also facilitate focused transmission of the load from the hooks 112A, 112B to the outer casing 69, the support structure 74, or both.

The example retractor 108 may be directly secured to the radially inward facing surfaces 116, but is often made separate, as shown, to facilitate assembly. Separating the retractor 108, and thus the actuating assembly 100, from the BOAS segment 76 may inhibit thermal energy from the BOAS segment 76 from damaging the actuating assembly 100 or other structures. Separating the retractor 108 from the BOAS segment 76 also allows the BOAS segment 76 to more easily deflect or un-curl due to its relatively large thermal gradient.

One or more extensions 130 may extend radially outward from the retractor 108 at a position that is axially in line with the hook 112A. The extensions 130 contact the hook 112A to assist in circumferentially locating the BOAS segment 76.

Features of the disclosed examples include using retracting the BOAS segment using features other than the hooks that radially secure the BOAS segment during typical operation. Some examples use bumpers to act as radially stops. Some examples use an extension of the retractor as a circumferential locator for the BOAS segment.

Although embodiments of this invention have been disclosed, a worker of ordinary skill in the art would recognize that certain modifications would come within the scope of this invention. For that reason, the following claims should be studied to determine the true scope and content of this invention.

I claim:

1. A blade outer air seal (BOAS) actuator assembly, comprising:

an actuator member; and a retractor configured to move with the actuator member to move a BOAS segment from a first position to a second position that is radially outside the first position, the BOAS segment seated against a support structure when in the first position and spaced from the support structure when in the second position.

2. The BOAS actuator assembly of claim 1, wherein the retractor extends laterally from the actuator member.

3. The BOAS actuator assembly of claim 1, wherein the actuator member is a piston rod.

4. The BOAS actuator assembly of claim 1, wherein the retractor is separate from the BOAS segment.

5. The BOAS actuator assembly of claim 1, including at least one bumper extending radially from the retractor, the at least one bumper configured to contact a structure to limit radial movement of the BOAS segment.

6. The BOAS actuator assembly of claim 5, wherein the at least one bumper is configured to contact the structure when the BOAS segment is in the second position.

7. The BOAS actuator assembly of claim 5, wherein the structure comprises a control ring.

8. The BOAS actuator assembly of claim 5, wherein the retractor has a triangular profile.

9. The BOAS actuator assembly of claim 8, wherein the at least one bumper includes a bumper near each corner of the retractor.

10. The BOAS actuator of claim 1, including an attachment structure extending from a radially outer face of the BOAS segment, the attachment structure including at least one hook.

11. The BOAS actuator of claim 10, wherein the attachment structure of the BOAS segment seated against a support structure when in the first position and spaced from the support structure when in the second position.

12. A blade outer air seal (BOAS) assembly, comprising:

a seal body having a radial inner face that circumferentially extends between a first mate face and a second mate face and axially extends between a leading edge face and a trailing edge face;

an attachment structure extending from a radially outer face of the seal body, the attachment structure including at least one hook; and a retractor configured to contact the at least one hook to move a BOAS segment from a first position to a second position that is radially outside the first position, the attachment structure of the BOAS segment seated against a support structure when in the first position and spaced from the support structure when in the second position.

13. The BOAS assembly of claim 12, wherein the retractor is disconnected from the hook.

14. The BOAS assembly of claim 12, wherein the retractor is moveable relative to the hook.

15. The BOAS assembly of claim 12, wherein the BOAS segment is biased toward the first position.

16. The BOAS assembly of claim 15, wherein bleed air provides a biasing force.

17. The BOAS assembly of claim 15, wherein the retractor includes a radially inner surface that directly contacts the support structure in the first position.

* * * * *